US008096804B2

(12) United States Patent
Boyer et al.

(10) Patent No.: US 8,096,804 B2
(45) Date of Patent: Jan. 17, 2012

(54) DEVICE FOR CONTROLLING THE RADIAL PROFILE OF THE TEMPERATURE OF A CONFINED GAS STREAM

(75) Inventors: Christophe Boyer, Charly (FR); André Nicolle, Saint-Genis-Laval (FR); Willi Nastoll, Les Roches de Condrieu (FR); Robert Sanger, Mount Prospect, IL (US)

(73) Assignee: IFP Energies Nouvelles, Rueil MalmaisonCedex (FR)

( * ) Notice: Subject to any disclaimer, the term of this patent is extended or adjusted under 35 U.S.C. 154(b) by 893 days.

(21) Appl. No.: 12/112,140

(22) Filed: Apr. 30, 2008

(65) Prior Publication Data

US 2009/0272301 A1 Nov. 5, 2009

(51) Int. Cl.
*F23D 11/44* (2006.01)
*C01B 3/32* (2006.01)

(52) U.S. Cl. ..... 431/207; 48/198.8; 432/222

(58) Field of Classification Search ..... 431/207; 110/215, 203, 264, 345; 48/198.8; 165/65; 432/222; 60/39.5, 272

See application file for complete search history.

(56) References Cited

U.S. PATENT DOCUMENTS 3,930,789 A * 1/1976 Erich et al. ..... 432/222
4,137,041 A * 1/1979 Woodroff et al. ..... 432/222
6,526,746 B1 * 3/2003 Wu ..... 60/286
7,018,435 B1 3/2006 Wentinck

* cited by examiner

*Primary Examiner* — Kenneth Rinehart
*Assistant Examiner* — Chuka C Ndubizu
(74) *Attorney, Agent, or Firm* — Millen, White, Zelano & Branigan, P.C.

(57) ABSTRACT

This invention describes a new device for controlling the radial profile of the temperature of a confined gas stream that is designed to be used as a coolant in an exchanger that is located downstream from said device.

11 Claims, 4 Drawing Sheets

DEVICE FOR CONTROLLING THE RADIAL PROFILE OF THE TEMPERATURE OF A CONFINED GAS STREAM

FIELD OF THE INVENTION

This invention relates to a device for controlling the temperature of a confined gas stream, whereby the confined gas stream constitutes a hot fluid that is obtained from, for example, combustion and is designed, after cooling, to be used as a coolant in an exchanger that is located downstream from this device. The exchanger that is located downstream is not part of this invention and can be of any type.

The device according to the invention makes it possible both to reduce the temperature of the confined gas stream while adhering to a given radial temperature profile.

The device according to the invention can, for example, be placed along a circuit of gases and makes it possible to feed a confined gas stream that is at reduced temperature and that has the most homogeneous radial temperature profile possible over its entire section.

More particularly, the device according to the invention is used with combustion gases that are available at a temperature that can reach 2500° C., generally between 1000° C. and 2500° C., and that are desired to be brought to a temperature of less than 1000° C. in a perfectly homogeneous manner, i.e., with a radial profile of said temperature that is "flat" according to any section of the confined gas stream.

This problem of radial homogeneity is complex because the hot confined gas stream, for example obtained from combustion that is produced by means of a burner, generally has a radial temperature profile that is marked by significant differences between the temperature at the center of the stream and the temperature at the periphery of said stream. According to the technology of the burner that is used and the rate of flow, most often turbulent, it is not rate to observe temperatures at the center of the confined gas stream that are close to 2500° C. and temperatures at the periphery of about 1500° C.

The first object attained by this invention is to lower the temperature of a "hot" confined gas stream that is available at a temperature of between 1000° C. and 2500° C. and that may have radial temperature heterogeneities to a level that is less than 1000° C., more particularly less than 700° C. in a given time that is less than 1 second, such that the resulting confined gas stream, called "cold" stream, is characterized by the most homogeneous radial temperature profile possible.

The device also makes it possible to provide—at the walls of this device that are in contact with the confined gas stream to be treated—a zone inside of which the temperature of said confined gas stream is always less than that of the periphery of said vein and, if possible, less than 500° C., which makes it possible to produce the major portion and even the entirety of said device in a less expensive metallurgy.

It should be noted that this second object is antagonistic to the first to a certain extent, since it is ultimately a matter of obtaining a confined gas stream that has a homogeneous radial profile, whereas the second object consists in producing—over the entire passage of the device by the confined gas stream—a radial profile of the latter, characterized by a cold wall zone (less than 500° C.), whereas the central zone can reach temperatures of 1500° C. for the purpose of protecting the walls of the device from excessive temperatures.

This device therefore makes it possible to solve a problem that can be defined by two objects, whereby the first object consists in producing—at the passage of the device—a profile having a cold wall zone and whereby the second object consists in producing—at the output of said device—a "flat" profile, whereby the two objects should be achieved by adhering to a total dwell time of less than 1 second.

EXAMINATION OF THE PRIOR ART

The U.S. Pat. No. 7,018,435 B1 describes a device in which the fuel is injected close to the wall around an oxidizer jet so as to ensure a good oxidizer/fuel mixture before entering the reaction section, in this case a catalytic oxidation reaction. However, this invention does not aim at monitoring the temperature of the chamber in which the oxidation takes place. In addition, in this invention, the central flow is not put into rotation.

It is also possible to mention the technology of Westinghouse in its so-called "multi-annular" burner that makes use of a coolant that is injected into an annular pipe that comprises a baffle, but into which said fluid is not brought into rotation. In addition, the burner that is used in this technology is necessarily a burner that has a device for rotating combustion gases. From a general point of view, the principle of injecting a secondary fluid in an approximately tangential way in comparison to the flow axis of the main fluid, in order to cool down this main fluid and also to transmit to it a swirl movement, is well known to a man skilled in the art.

The actual invention provides a complete set of specific ratios allowing to define the geometry of the device in order to reach the goals previously described.

BRIEF DESCRIPTION OF THE FIGURES

FIG. 2 corresponds to a reading taken at the input of the combining cone, and FIG. 3 corresponds to a reading taken at the output of the device.

FIG. 4 is obtained without the device, and FIG. 5 is obtained with the device according to the invention.

SUMMARY DESCRIPTION OF THE INVENTION

Figure 1A:
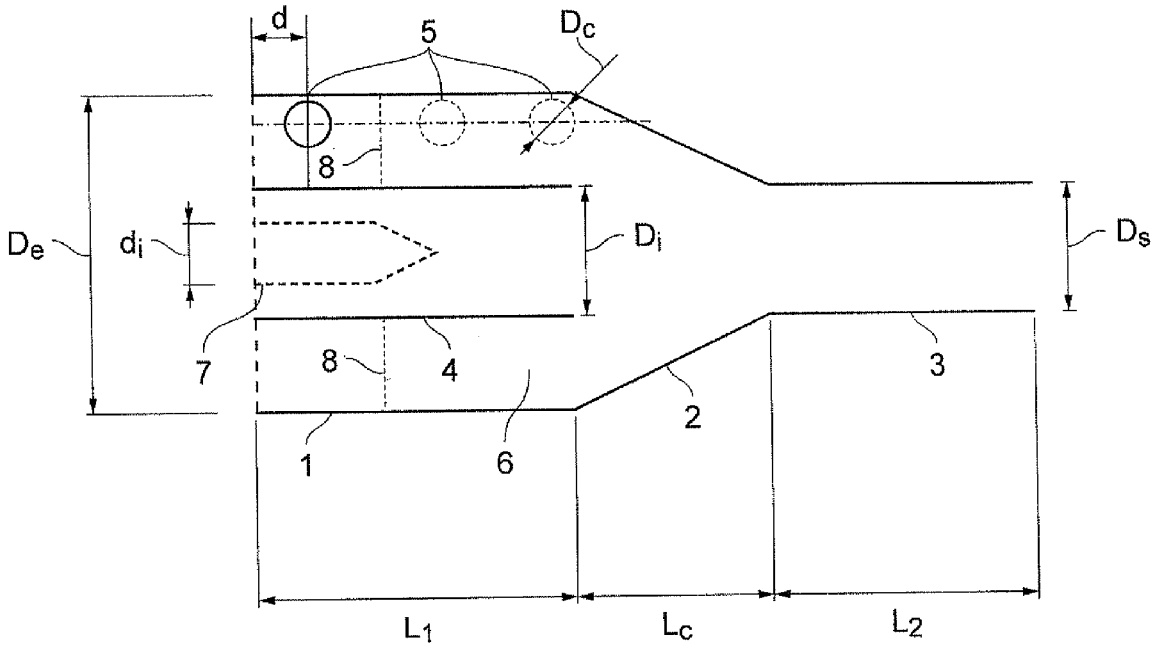
FIGS. 1*a* and 1*b* provide a diagrammatic front and end view of representations of the device according to this invention in the general case of a confined gas stream that is obtained from an upstream combustion. The particular case where the hot stream is generated by a burner that is placed in situ, i.e., in the very interior of this device, is shown in dotted lines in this figure.
Figure 1B:
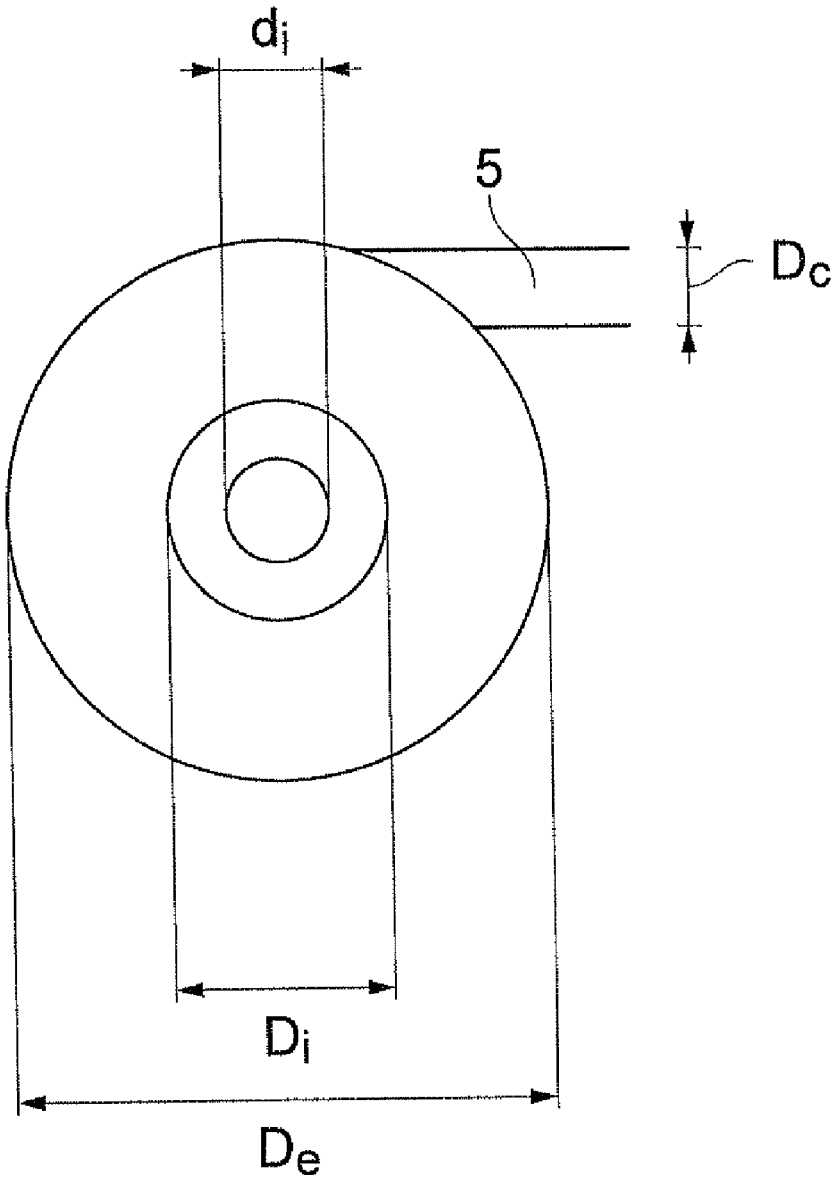

The device according to the invention can be defined as a device that is designed to cool a hot confined gas stream by adhering to a temperature restriction in the wall of said confined gas stream, throughout the passage of said device, and the most homogeneous radial temperature profile possible at the output of said device.

More specifically, the device according to the invention is an axisymmetrical device for controlling the temperature of a hot confined gas stream that is contained in an inside pipe (4) with a diameter Di that comprises:

- A cylindrical chamber (1) with a diameter De that surrounds the pipe with a diameter Di over a length L1,
- A convergent conical portion (2) with a length Le that makes it possible to pass from the diameter De to the diameter Ds that is strictly smaller than De, A cylindrical pipe (3) with a diameter Ds that extends over a length L2, At least one intake pipe (5) of a coolant with a diameter Dc that is located perpendicular to the section of the device at the annular zone that is delimited by the cylindrical chamber (1) and the pipe (4) with a diameter Di.

The intake pipe (5) makes it possible to feed coolant to the annular portion (6) that is between the outside cylindrical chamber (1) and the inside pipe (4).

According to a preferred characteristic of the device according to the invention, the intake pipe (5) of the coolant is located at a distance d from the input section of the device, whereby d/Di is greater than 0.1.

According to another preferred characteristic of the device according to the invention, the inside pipe (4) contains a burner that extends approximately over a length that is equal to (L1)/2.

Because of the temperature profile that is produced by the device, the cylindrical chamber (1) with a diameter De is generally made of ordinary steel.

The hot stream that is to be cooled can be generated by any combustion system that produces combustion gases up to a temperature that can reach 2500° C. In some cases, the hot confined gas stream is generated by a burner in situ, i.e., placed within the device inside the inside pipe with a diameter Di. In this case, the length of the flame tube that contains said burner is preferably between 0.5 L1 and 0.8 L1.

In a preferred manner, a grid (8) is arranged in the annular space (6) in a plane that is approximately perpendicular to the axis of the device at a distance of between L1/4 and L1/2 from the input of the device (corresponding to the abscissa X=0).

When the hot vein is generated by a burner in situ and when said burner generates a movement in rotation of the combustion gases, the coolant is introduced into the annular space by the pipe (5), preferably so as to produce a movement of rotation of said coolant in the same direction as the movement of rotation of the combustion gases obtained from the burner.

The invention can also be defined as a process for cooling a hot confined gas stream by means of the device according to this invention, in which the coolant is injected through the pipe (5) at a mean speed of generally between 5 m/s and 80 m/s, and preferably between 10 m/s and 30 m/s. Said speed is related to the section of the intake pipe (5) or to each of said intake pipes when there are several of them.

The process for cooling a hot confined gas stream by means of the device according to the invention makes it possible to produce a wall zone inside of which the temperature is generally between 200° C. and 500° C.

Finally, the process for cooling a hot confined gas stream by means of the device according to the invention simultaneously makes it possible to produce at the output of said device a radial temperature profile that is homogeneous over its entire section, i.e., with a temperature difference between the temperature at the center of the confined gas stream and the temperature at the periphery of the confined gas stream that is less than 35%.

DETAILED DESCRIPTION OF THE INVENTION

This invention describes a device that makes it possible to lower the temperature of a hot confined gas stream, contained in a pipe (4) with a diameter Di, while ensuring its homogeneity in the entire section of said vein.

The device consists of an axisymmetrical unit that comprises:

A cylindrical chamber (1) with a diameter De surrounding the pipe (4) with a diameter Di over a length L1, A convergent conical portion (2) with a length Lc that makes it possible to pass from the diameter De to the diameter Ds, strictly smaller than De, A cylindrical pipe (3) with a diameter Ds that extends over a length L2, At least one intake pipe (5) for a coolant with a diameter Dc, located perpendicular to the primary axis of the device and making it possible to feed coolant to the annular portion (6) that is between the outside cylindrical chamber (1) with a diameter De and the pipe (4) with a diameter Di, whereby the device adheres to the following proportions:

L1/Di between 0.5 and 2 and preferably between 1 and 2

Lc/Di between 0.5 and 5 and preferably between 0.6 and 2

L2/Di between 1.5 and 10 and preferably between 2 and 5

De/Di between 0.1 and 0.4 and preferably between 0.2 and 0.3

De/Di between 1 and 5 and preferably between 1 and 2.

To understand the remainder of the text, X should be noted as the primary axis of symmetry of the device that corresponds to the coordinate according to which the different lengths (L1, Lc, L2, . . . ) are counted, and, also from the process standpoint, the coordinate according to which the confined gas stream flows.

Y should be noted as the axis that is perpendicular to the X-axis and that contains the intake pipe (5).

Finally, Z should be noted as the axis that is perpendicular to the plane that contains the X-axis and the Y-axis.

The intake pipe (5) of the coolant is preferably located at a distance d from the input section of the device (X=0), such that d/Di is more than 0.1. This intake pipe can be unique or can be divided into a certain number of intake pipes that are uniformly distributed along the X-axis.

In the case of multiple intake pipes (5), the selection of the number and the diameter of each of the pipes is made so as to adhere both to the total flow rate of the coolant that allows the temperature of the confined gas stream to be lowered to the desired temperature and the criterion of the output speed of the cooling gas.

Generally, the output speed of the coolant at the intake pipe(s) (5) is between 5 m/s and 80 m/s and preferably between 10 m/s and 30 m/s.

The direction of the speed vector of the coolant at the intake pipe (5) is perpendicular to the X-axis, so as to induce a movement of rotation of said coolant inside the annular space (6). This movement of rotation has the effect of homogenizing the flow of said coolant all around the annular space (6) and thus homogenizing the temperature field at the periphery of the device.

It has been shown that this rotation of the coolant contributes to keeping a reduced temperature at the periphery of the walls of the annular zone (6) throughout the mixing process with the confined gas stream to be cooled.

The confined gas stream to be cooled can be generated upstream from this device in any heat generation system, such as a furnace, or can be generated by a burner that is placed in the very interior of said device. This invention is compatible with any type of burner, whether this burner has premixing (or preliminary mixing of fuel and oxidizer) or not. In a preferred manner, the burner will produce a non-premixed, so-called diffusion, flame.

This invention is also compatible with any type of gas or liquid fuel. Generally, the fuel consists of any hydrocarbon fraction or light gases that may contain hydrogen. The oxidizer is generally air, but it can also be enriched air and even, in some cases, pure oxygen.

Even more preferably, the burner that generates the hot confined gas stream is a burner that comprises a device for rotating generated combustion gases (called "swirl" in English terminology). In this case, the rotation of the coolant inside the annular zone (6) is done in the same direction as the rotation of the combustion gases generated by the burner.

Preferably, the burner is placed inside a tube, called a flame tube, whose diameter di is approximately between 0.2 Di and 1 Di.

Even more preferably, the length of the flame tube that contains the burner is approximately between 0.5 L1 and 0.8 L1.

The structure of the radial temperature profile of the hot confined gas stream, after mixing with the coolant, has a wall zone inside of which the temperature of the confined gas stream is less than 500° C. over the entire length of the device and less than 700° C. at any point located downstream from the device. Under these conditions, it is possible to use a steel of type 309 according to the AISI Standard (i.e., with a typical composition of 24% Cr and 14% Ni) or any other equivalent steel for the walls that delimit the device and the pipes located downstream from said device.

The cylindrical pipe (3), inside of which the heat exchange continues between the confined gas stream to be cooled and the coolant, can undergo wall temperatures ranging up to 700° C. Without the device according to the invention, the selection of materials constituting the walls of the chambers that contain the confined gas stream would be much more restrictive because of a wall temperature on the order of 900° C. to 1200° C.

The annular space (6) between the pipe (4) and the cylindrical chamber (1) can comprise a grid (8) that is arranged in a plane that is approximately perpendicular to the axis of the device at a distance of between L1/4 and L1/2 relative to the origin X=0. The object of this grid is to homogenize the flows of coolant all around the annular zone (6).

The coolant is generally air at ambient temperature. It may also be an inert gas such as nitrogen, argon or helium. In some cases, the coolant can also consist of a mixture that contains CO2, such as gases that are cold enough and that do not contain water (gases called "dry gases").

In one particular case linked to the use downstream from the confined gas stream as a coolant, the coolant can consist at least in part of a fraction of the cooled confined gas stream after its use as coolant in an exchanger located downstream.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and, all parts and percentages are by weight, unless otherwise indicated.

EXAMPLE ACCORDING TO THE INVENTION

A comparison example that relates to a hot vein with and without the device according to the invention is provided.

The two effects—1) creation of a wall zone that is cooled on a defined portion of the device, and 2) confinement of the confined gas stream inside a cylindrical brush—are clearly demonstrated.

A hot vein is produced by a burner that is placed inside the pipe with a diameter di. The burner has a length that is equal to 250 mm.

The geometric data of the device according to the invention are as follows:

L1=320 mm, (L1/Di=1.58)
L2=400 mm, (L2/Di=1.98)
Lc=131 mm, (Lc/Di=0.648)
Ds=102 mm, (Ds/Di=0.50)
De=254 mm, (De/Di=1.257)
Di=202 mm,
Dc=52 mm, (Dc/Di=0.257)
Di=78 mm, (di/Di=0.386).

The oxidizer consists of air with a flow rate of 10.8 g/s, and the fuel consists of liquid ethanol with a flow rate of 1.06 g/s.

A diffusion flame is stabilized at the output of the flame tube with a diameter di=78 mm, or with a ratio di/Di of 0.386.

In the annular space (6) between the pipe with a diameter Di and the outside jacket with a diameter De, a flow of cooling air is injected perpendicular to the section of the device, with a flow rate of 35 g/s, corresponding to a speed of 14.0 m/s.

This flow of cooling air ensures the rotation of said fluid over the entire annular space (6). The cooling air is introduced via the pipe (S) with a diameter Dc=52 mm, located at a distance of 50 mm from the beginning of the device (X=0) and perpendicular to the X-axis of the device.

The case without a device corresponds to the absence of cooling air injection. The mean temperature of the confined gas stream is then 1900° C.

The case with a device corresponds to the injection of cooling air in the annular space (6) between the pipe with a diameter Di and the outside jacket with a diameter De. The mean temperature of the confined gas stream after mixing with the coolant is then 700° C. The wall temperature is also always less than 580° C.

Figure 2:
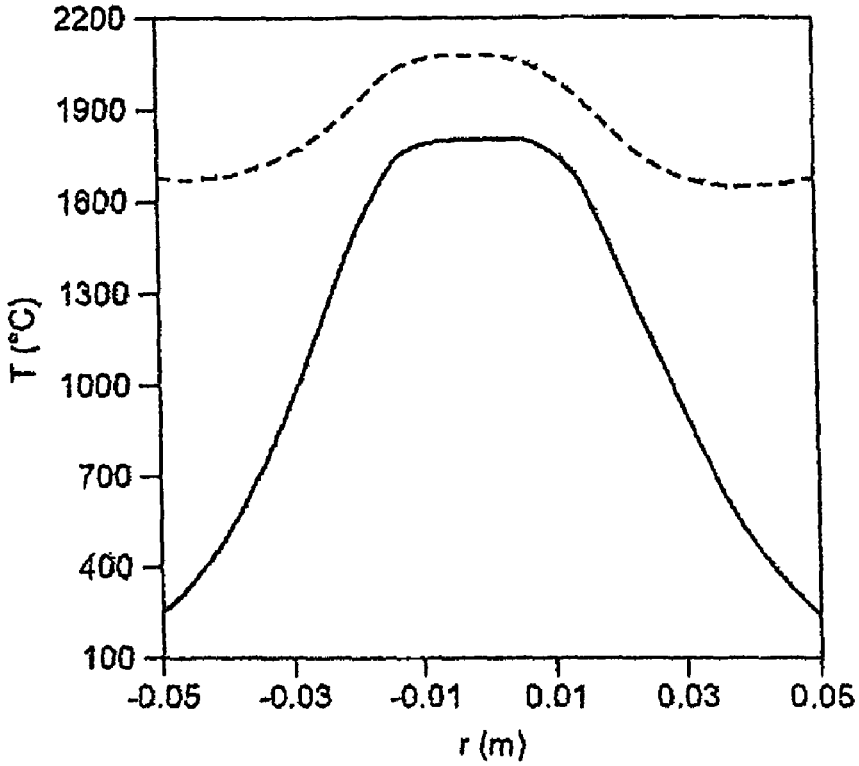
FIGS. 2 and 3 show radial profile readings of the temperature taken in the confined gas stream with the device (continuous lines) and without the device according to the invention (lines in dotted form).
Figure 3:
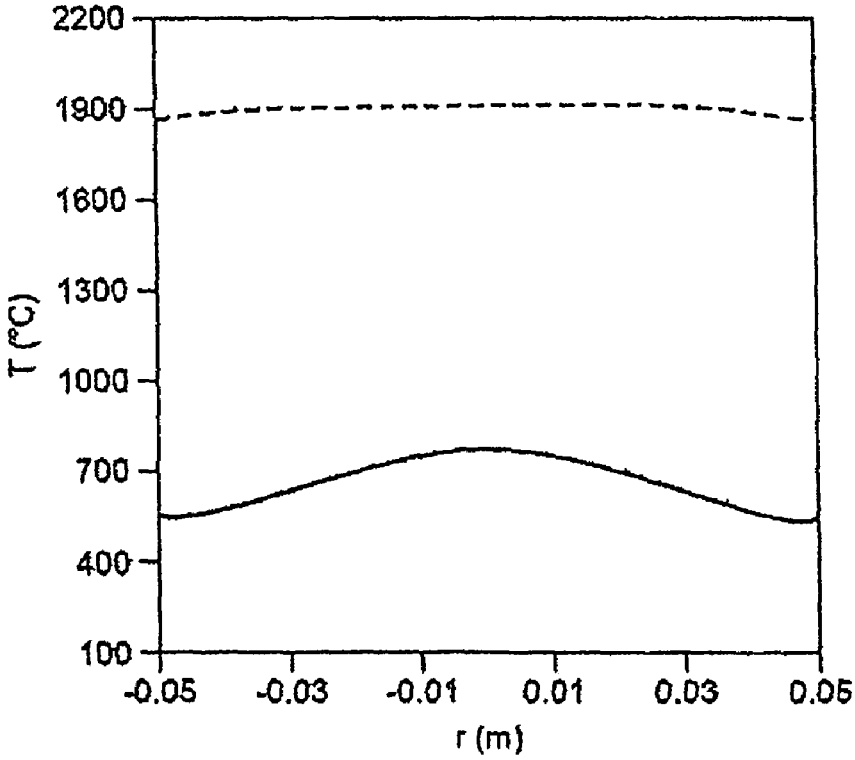

FIGS. 2 and 3 exhibit results of digital simulations produced using a mechanical code of fluids, whereby the hot confined gas stream is generated by a burner in situ with a diameter di=78 mm.

FIG. 2 corresponds to a comparative profile with the device (curve in solid lines) and without the device (curve in dotted lines), whereby the plane of the readings is the cutting plane located at the input of the combining cone (X=L1).

FIG. 3 corresponds to a comparison profile with the device (curve in solid lines) and without the device (curve in dotted lines), whereby the plane of reading is the cutting plane located at the output end of the device (X=L1=Lc+L2).

It is noted that with the device, the radial temperature profile has—on the walls—a cooled zone, inside of which the temperature is about 300° C., a zone that does not exist without the device where the temperature in the wall zone is approximately 1600° C.

This cooling effect with walls makes it possible to use ordinary steel metallurgy on the walls (4) and (2) that constitute the device.

In addition, in FIG. 3, it is observed that the radial profile is homogeneous in the direction where the temperature difference between the center (T=730° C.) and the walls (T=550° C.) is less than 35%.

It should be noted that this level of homogeneity at the output of the device is difficult to produce taking into account that one of the functions of the device is to create, permanently, a so-called "wall" temperature zone that is less than 500° C., so as to protect the corresponding walls of said device.

The homogeneity performance level of the radial temperature profile at the output of the device should be assessed by taking into account the second object that makes it possible to produce the device according to the invention that is the creation of a "cold" wall zone.

Figure 4:
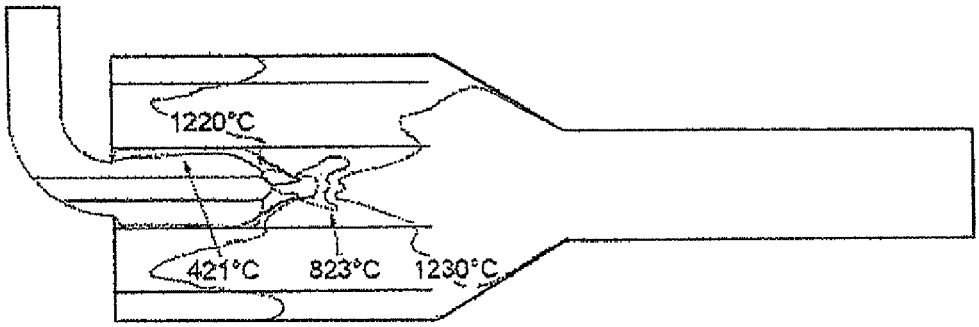
FIGS. 4 and 5 show isotemperature cartographies carried out in a cutting plane that is perpendicular to the axis of the device.
Figure 5:
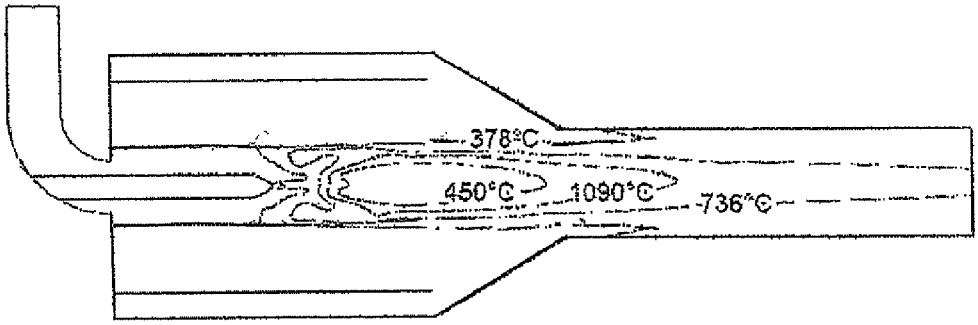

FIGS. 4 and 5 show isotemperature cartographies and make it possible to visualize the temperature fields with and without the device.

FIG. 4 (without the device) indicates a spread of isotemperature curves in particular around the conical zone (2), whereas in FIG. 5 (with the device), a very considerable tightening of the isotemperature curves that are concentrated in a cylindrical brush approximately aligned with the flame tube is observed.

This tightening effect is particularly advantageous since it makes it possible to confine the hot vein while maintaining a cold wall zone.

The entire disclosure of all applications, patents and publications, cited herein is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Axisymmetrical device for controlling the temperature of a hot confined gas stream that is contained in an inside pipe (4) with a diameter Di that comprises:

A cylindrical chamber (1) with a diameter De that surrounds the pipe with a diameter Di over a length L1, A convergent conical portion (2) with a length Lc that makes it possible to pass from the diameter De to diameter Ds that is strictly smaller than De, A cylindrical pipe (3) with a diameter Ds that extends over a length L2, At least one intake pipe (5) of a coolant with a diameter Dc that is located perpendicular to the section of the device and that makes it possible to feed coolant to an annular portion (6) that is between the outside cylindrical chamber (1) and the inside pipe (4), whereby the device adheres to the following proportions:

L1/Di between 0.5 and 2

Lc/Di between 0.5 and 5

L2/Di between 1.5 and 10

Dc/Di between 0.1 and 0.4

De/Di between 1 and 5.

2. Axisymmetrical device for controlling the temperature of a hot confined gas stream that is contained in a pipe (4) with a diameter Di according to claim 1, in which the intake pipe (5) of the auxiliary fluid is located at a distance d from the input section of the device, whereby d/Di is greater than 0.1.

3. Axisymmetrical device for controlling the temperature of a hot confined gas stream that is contained in a pipe (4) with a diameter Di according to claim 1, in which the inside pipe (4) contains a burner that extends approximately over a length that is equal to (L1)/2.

4. Axisymmetrical device for controlling the temperature of a hot confined gas stream that is contained in a pipe (4) with a diameter Di according to claim 1, in which the cylindrical chamber (1) with a diameter De is made of ordinary steel.

5. Axisymmetrical device for controlling the temperature of a hot confined gas stream that is contained in a pipe (4) with a diameter Di according to claim 1, in which a grid (8) is arranged in the annular space (6) in a plane that is approximately perpendicular to the axis of the device at a distance between L1/4 and L1/2.

6. A process for cooling a hot confined gas stream by providing an axisymmetrical device for controlling the temperature of a hot confined gas stream that is contained in an inside pipe (4) with a diameter Di that comprises:

A cylindrical chamber (1) with a diameter De that surrounds the pipe with a diameter Di over a length L1, A convergent conical portion (2) with a length Lc that makes it possible to pass from the diameter De to diameter Ds that is strictly smaller than De, A cylindrical pipe (3) with a diameter Ds that extends over a length L2, At least one intake pipe (5) for a coolant with a diameter Dc that is located perpendicular to the section of the device and that makes it possible to feed the coolant to an annular portion (6) that is between the outside cylindrical chamber (1) and the inside pipe (4), whereby the device adheres to the following proportions:

L1/Di between 0.5 and 2

Lc/Di between 0.5 and 5

L2/Di between 1.5 and 10

Dc/Di between 0.1 and 0.4

De/Di between 1 and 5 and injecting the coolant at a mean speed of between 5 m/s and 80 m/s into said intake.

7. A process for cooling a hot confined gas stream by providing an axisymmetrical device for controlling the temperature of a hot confined gas stream that is contained in an inside pipe (4) with a diameter Di that comprises:

A cylindrical chamber (1) with a diameter De that surrounds the pipe with a diameter Di over a length L1, A convergent conical portion (2) with a length Lc that makes it possible to pass from the diameter De to diameter Ds that is strictly smaller than De, A cylindrical pipe (3) with a diameter Ds that extends over a length L2, At least one intake pipe (5) for a coolant with a diameter Dc that is located perpendicular to the section of the device and feeding the coolant to an annular portion (6) that is between the outside cylindrical chamber (1) and the inside pipe (4), whereby the device adheres to the following proportions:

L1/Di between 0.5 and 2

Lc/Di between 0.5 and 5

L2/Di between 1.5 and 10

Dc/Di between 0.1 and 0.4

De/Di between 1 and 5 wherein the coolant is air at ambient temperature, rotated in a plane that is perpendicular to the axis of the device.

8. A process for cooling a hot confined gas stream by providing an axisymmetrical device for controlling the temperature of a hot confined gas stream that is contained in an inside pipe (4) with a diameter Di that comprises:

A cylindrical chamber (1) with a diameter De that surrounds the pipe with a diameter Di over a length L1, A convergent conical portion (2) with a length Lc that makes it possible to pass from the diameter De to diameter Ds that is strictly smaller than De, A cylindrical pipe (3) with a diameter Ds that extends over a length L2, At least one intake pipe (5) for a coolant with a diameter Dc that is located perpendicular to the section of the device and feeding said coolant to an annular portion (6) that is between the outside cylindrical chamber (1) and the inside pipe (4), whereby the device adheres to the following proportions:

L1/Di between 0.5 and 2

Lc/Di between 0.5 and 5

L2/Di between 1.5 and 10

Dc/Di between 0.1 and 0.4

De/Di between 1 and 5 wherein the confined gas stream at the conical portion (2) of the device has a wall zone inside of which the temperature is between 200° C. and 500° C.

9. A process for cooling a hot confined gas stream by providing an axisymmetrical device for controlling the temperature of a hot confined gas stream that is contained in an inside pipe (4) with a diameter Di that comprises:

A cylindrical chamber (1) with a diameter De that surrounds the pipe with a diameter Di over a length L1, A convergent conical portion (2) with a length Lc that makes it possible to pass from the diameter De to diameter Ds that is strictly smaller than De, A cylindrical pipe (3) with a diameter Ds that extends over a length L2, At least one intake pipe (5) of a coolant with a diameter Dc that is located perpendicular to the section of the device and feeding the coolant to an annular portion (6) that is between the outside cylindrical chamber (1) and the inside pipe (4), whereby the device adheres to the following proportions:

L1/Di between 0.5 and 2

Lc/Di between 0.5 and 5

L2/Di between 1.5 and 10

Dc/Di between 0.1 and 0.4

De/Di between 1 and 5 in which the confined gas stream at the output of the device has a radial temperature profile exhibiting a temperature difference between the temperature at the center and the temperature at the edges that is less than 35% of the temperature at the edges.

10. A device according to claim 1 adhering to the following proportions:

L1/Di between 1 and 2

Lc/Di between 0.6 and 2

L2/Di between 2 and 5

Dc/Di between 0.2 and 0.3

De/Di between 1 and 2.

11. A process according to claim 8, wherein the coolant is injected at a mean speed of between 10 m/s and 30 m/s.

* * * * *